United States Patent [19]

Sakakima et al.

[11] 4,437,912

[45] Mar. 20, 1984

[54] AMORPHOUS MAGNETIC ALLOYS

[75] Inventors: Hiroshi Sakakima, Hirakata; Mitsuo Satomi, Katano; Harufumi Senno, Yamatokoriyama; Eiichi Hirota, Hirakata, all of Japan

[73] Assignee: Matsushita Electric Industrial Co., Ltd., Osaka, Japan

[21] Appl. No.: 321,560

[22] Filed: Nov. 16, 1981

[30] Foreign Application Priority Data

Nov. 21, 1980 [JP] Japan ..... 55-164978

[51] Int. Cl.[3] ..... C22C 19/00

[52] U.S. Cl. ..... 148/403; 75/123 R; 75/123 B; 75/123 H; 75/123 J; 75/123 L; 75/123 A; 75/124; 75/126 F; 75/126 G

[58] Field of Search ..... 420/435, 441, 459; 148/403, 425, 426; 75/123 R, 123 A, 123 B, 75/123 H, 123 J, 123 L, 124 R, 124 A, 124 B, 124 C, 75/124 E, 124 F, 126 F, 126 G

[56] References Cited

U.S. PATENT DOCUMENTS

| | | | |
|---|---|---|---|
| 3,986,867 | 10/1976 | Masumoto et al. | 75/128 G |
| 4,056,411 | 11/1977 | Chen | 75/124 R |
| 4,067,732 | 1/1978 | Ray | 75/128 F |
| 4,116,682 | 9/1978 | Polk et al. | 75/123 J |
| 4,137,075 | 1/1979 | Ray | 148/403 |
| 4,152,144 | 5/1979 | Hasegawa et al. | 148/403 |
| 4,188,211 | 2/1980 | Yamaguchi et al. | 148/403 |
| 4,221,592 | 9/1980 | Ray | 75/123 B |
| 4,225,339 | 9/1980 | Inomata et al. | 148/403 |
| 4,318,738 | 3/1982 | Masumoto et al. | 148/403 |

FOREIGN PATENT DOCUMENTS 53-104897 9/1978 Japan .

*Primary Examiner*—John P. Sheehan

*Attorney, Agent, or Firm*—Stevens, Davis, Miller & Mosher

[57] ABSTRACT

Amorphous alloy consisting mainly of 60–94 atomic % of at least one transition metal, and over 2 atomic % but below 20 atomic % of niobium. The amorphous alloys according to the invention are high in wear resistance and corrosion resistance and have a high saturated magnetic flux density and soft magnetic properties. The amorphous alloys have particular utility as core materials for magnetic heads.

4 Claims, 9 Drawing Figures

AMORPHOUS MAGNETIC ALLOYS

BACKGROUND OF THE INVENTION

This invention relates to amorphous magnetic alloys that can be readily produced and have superior mechanical properties and superior corrosion resistance.

In recent years, advances made in the progress of super-rapid cooling or super-quenching technology have made it possible to produce a variety of amorphous magnetic alloys. There are reports in the literature that amorphous alloys, such as Fe—P—C, Co—P—B, Ni—B, etc., have been produced by the gun method, piston anvil method and splat quenching method of. It is known that amorphous alloys can be obtained by combining P, C and B with transition metals. Of these elements, P raises the problems that, because of its low vapor pressure, when producing a P-containing alloy it is liable to shift the P content from a desired value and to bring about environmental pollution. On the other hand, C poses the problem that difficulties are encountered in dissolving it into a transition metal during melting to form solid solution thereof and in achieving separation and precipitation of the solid solution, thereby making production difficult. Thus, B is known as the most promising element today. The aforesaid production methods of the prior art have given way to a double roll process or a single roll process which is now the mainstay of the methods for producing amorphous magnetic alloys. This is because, while the methods of the past have only enabled amorphous alloys to be obtained in unstable thin pieces, the double roll and single roll processes enable amorphous magnetic alloys to be produced in a ribbon form of constant width and thickness, so that the double and single roll processes have great advantages in industrial viewpoint.

The double roll process is higher than the single roll process in the ability to render molten metal amorphous because the former converts an alloy in molten form into an amorphous state by rolling and rapid cooling carried out from both sides of the alloy in molten metal form while the latter carries out cooling from one side only. However, the double roll process suffers the disadvantage that, since rolling and rapid cooling of an alloy in molten metal form are carried out, the surfaces of the rolls are liable to be damaged and great difficulties are encountered in obtaining an amorphous alloy in an elongated strip form of large width and length. Thus, the present condition is such that the single roll process has to be relied on in view of producing amorphous alloys on a mass production basis.

The single roll process now available is capable of producing amorphous alloys in the form of ribbon of a large width or a width of about 20 cm while the double roll process produces amorphous alloys in the form of ribbon of a width of no more than 2 cm. This can be accounted for by the fact that, while in the single roll process the apparatus can be made ready for the production of large width ribbon merely by increasing the width of the single roll, it is necessary in the double roll process not only to increase the width of the two rolls but also to increase the horse power of the motor and the strength of the bearings for carrying out rolling, thereby rendering the apparatus larger in scale. Further, as is well known, amorphous magnetic alloys have very high hardness, so that it is quite difficult to avoid damage of the surfaces of the rolling rolls used in the double roll process. In the single roll process, on the other hand, molten metal is merely blown against the surface of the single roll to obtain rapid cooling thereof, so that the roll surface is free from damage. In view of this characteristic, the single roll process is the mainstay for producing amorphous magnetic alloys because the alloys can be produced on a mass production basis by this process, despite low rapid cooling ability.

By the way, amorphous magnetic alloys of the composition containing a transition metal and boron can be readily produced in ribbon form with a width of about 1 cm by the double roll process, but the single roll process has been capable of only producing the alloys in ribbon form with a width of about 1-2 mm. When an attempt is made to increase the width, the temperature of the ribbon is 400°-600° C. when the solidified ribbon is released from the roll and wound because in the single roll process cooling is not effected sufficiently. Thus, the ribbon obtained is oxidized and turns yellow in color. The amorphous magnetic alloys obtained in this way have been very brittle, and they lack the mechanical properties of withstanding 180 degree bending inherently residing in amorphous alloys. Because the amorphous alloys are not only low in mechanical properties but also the alloys in ribbon form are partly crystallized, their magnetic properties also are not as they should be. Thus, difficulties have hitherto been encountered in obtaining amorphous magnetic alloys of the (Fe—Co—Ni)—B system of good properties in the form of ribbon of large width by the single roll process.

Amorphous magnetic alloys of the (Fe—Co—Ni)—Zr system and the (Fe—Co—Ni)—Zr—B system which are improvements on the (Fe—Co—Ni)—B system have since been developed. These materials can be more readily produced in the form of amorphous ribbon of large width by the single roll process than the alloys of the (Fe—Co—Ni)—B system. However, the alloy systems containing zirconium are liable to be oxidized, and it is quite difficult to melt a master alloy and rapidly cool the molten metal in the air by the single roll process, to obtain an amorphous alloy. Because of this, production of amorphous alloys is carried out in vacuum or inert gas atmosphere. However, this raises the problem of low productivity and high cost.

Amorphous alloys of the (Fe—Co—Ni)—Si—B system, (Fe—Co—Ni)—P—B system and (Fe—Co—Ni)—P—C system have also been known to be comparatively readily produced in the air in the form of ribbon. However, these alloys have been found to be low in wear resistance with respect to tape when these alloys have been made into magnetic head cores. This is a serious defect of amorphous alloys when one considers that amorphous alloys can have application in magnetic core heads by utilizing their soft magnetic properties.

SUMMARY OF THE INVENTION

This invention has been developed for the purpose of obviating the aforesaid disadvantages of the prior art. Accordingly, the invention has as its object the provision of amorphous magnetic alloys that have high wear resistance properties and combine high saturation magnetic flux density with soft magnetic properties when made into recording and reproducing magnetic head cores as magnetic materials with respect to metal tape.

The outstanding characteristics of the invention is that the amorphous magnetic alloys newly developed according to the invention are composed of mainly Nb and (Fe—Co—Ni). The use of Nb as an additive has been decided upon after conducting studies and experiments on a variety of elements. The conclusion to use Nb has been reached by taking into consideration the fact that the alloys of interest should be high in wear resistance and corrosion resistance. It has been ascertained by experiments that the amorphous magnetic alloys according to the invention can be readily produced by the single roll process in the form of ribbon of amorphous magnetic alloy of large width.

Figure 4A:
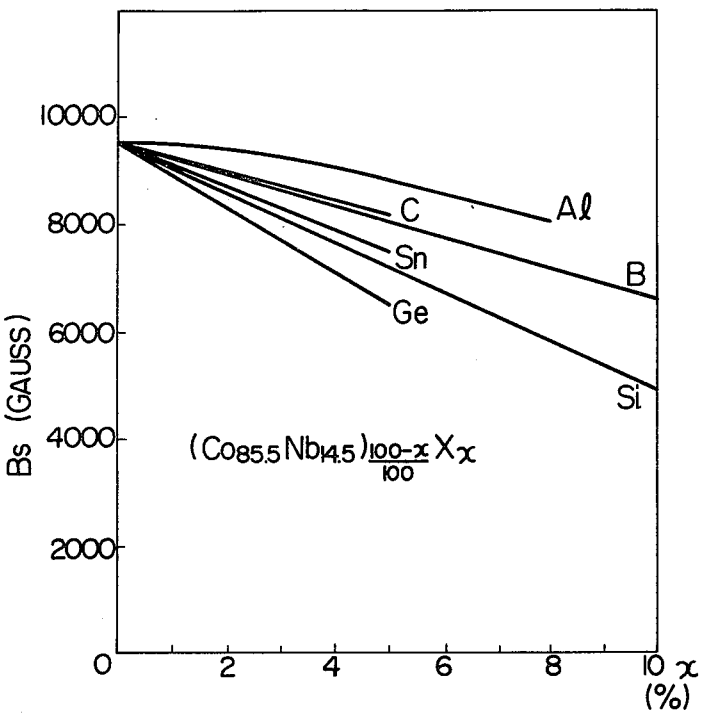
Figure 4B:
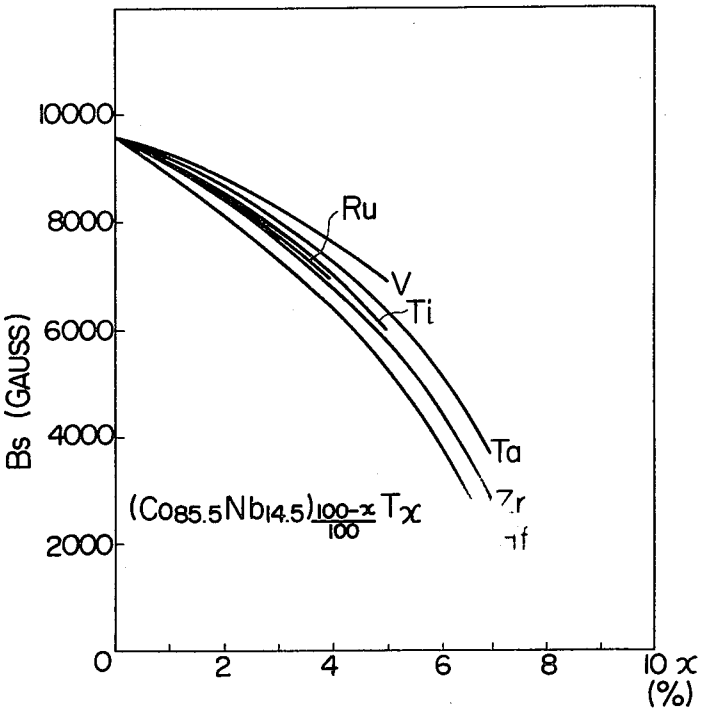

(wherein, x=2, 5, 10 and 12) and $Co_{75}Si_{10}B_{15}$;

FIG. 4 is a graph showing changes in the saturation magnetic flux density $B_s$ of amorphous alloys $$(Co_{85.5}Nb_{14.5})_{\frac{100-x}{100}}T_x \text{ and } (Co_{85.5}Nb_{14.5})_{\frac{100-x}{100}}X_x;$$

Figure 5:
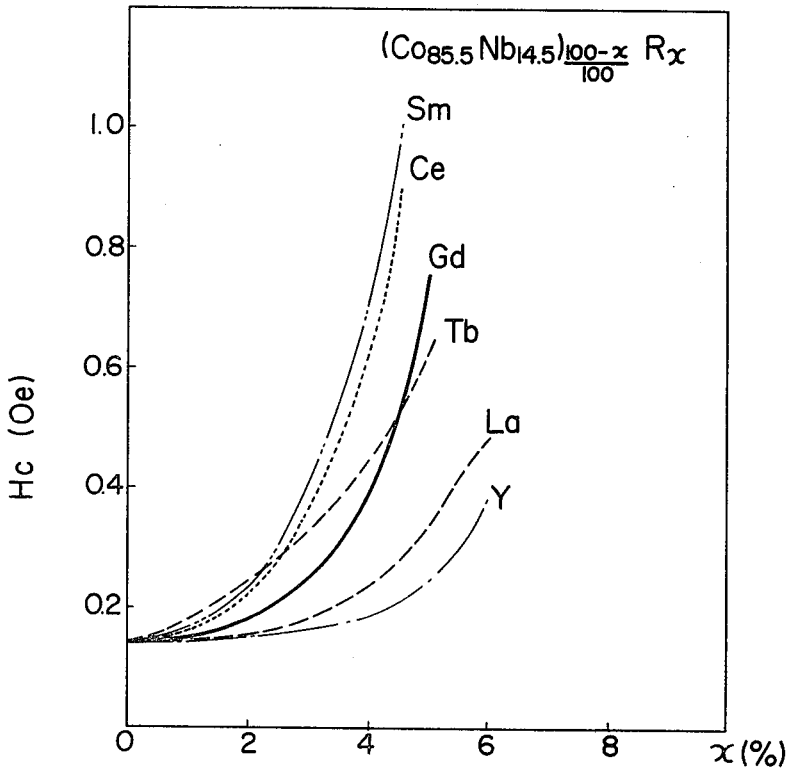

FIG. 5 is a graph showing changes in the coercive force $H_c$ of amorphous alloys $$(Co_{85.5}Nb_{14.5})_{\frac{100-x}{100}}R_x;$$

and

Figure 6A:
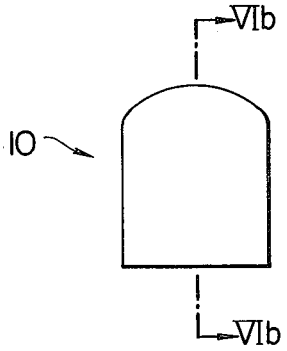
Figure 6B:
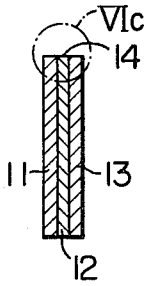
Figure 6C:
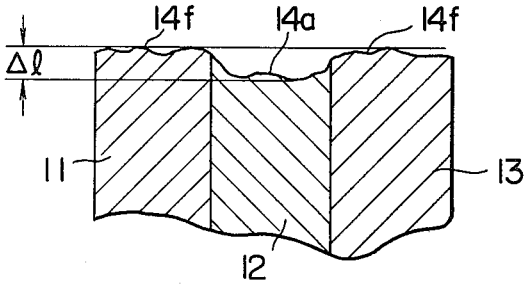

FIG. 6 is a view in explanation of the tests conducted on the wear resistance of amorphous alloys, wherein FIG. 6*a* is a plan view of the dummy head; FIG. 6*b* is a sectional view taken along the line VIb—VIb in FIG. 6*a;* and FIG. 6*c* is a view on an enlarged scale showing the circled portion VIc in FIG. 6*b*.

DETAILED DESCRIPTION OF THE PREFERRED EMBODIMENTS

It has been ascertained by experiments that the amorphous magnetic alloys according to the invention in which Nb is used as a basic element is superior to the aforesaid alloys of the (Fe—Co—Ni)—Si—B system, (Fe—Co—Ni)—P—B system and (Fe—Co—Ni)—P—C system in wear resistance. Also, the amorphous magnetic alloys according to the invention have been ascertained to have higher wear resistance properties than metal head core material now in use which is a Fe—Si—Al alloy.

The results of experiments have also revealed that the composition ranges that readily give birth to amorphous alloys are as follows.

(I) Alloys of the formula $M_aNb_bB_c$ wherein M is Fe, Co or Ni and; under the premises that a, b and c represent atomic % and under the condition that $$a+b+c=100;\ 60\leqq a\leqq 94,\ 2\leqq b\leqq 30 \text{ and } 0\leqq c\leqq 30.$$

Especially, when it is desired to easily obtain amorphous alloys in the form of ribbon having a width of over 4 cm and a thickness of over 40 μm, it is necessary to select the range of b as follows:

$$6\leqq b\leqq 30.$$

Further, when it is desired to impart magnetism to the amorphous alloys and to produce amorphous alloys in the air, the range of b is selected as follows:

$$2\leqq b\leqq 20$$

in order to avoid oxidation thereof.

Examples of the invention will now be described by referring to FIGS. 1 and 2.

EXAMPLE 1

Master alloys of the composition $Fe_4Co_{70}M_6B_{20}$ (wherein M is V, Nb, Cr, Mo, W, Mn, Pt, Cu, Au, Al, Ru, Rh or Ti) were prepared and attempts were made to produce amorphous alloys in the form of ribbon of a width of 2 cm by the single roll process. In the experiments, each master alloy was melted at 1450° C. and the molten alloy was ejected onto the surface of a rotating roll made of iron having a diameter of 30 cm rotating at 1400 r.p.m., through a nozzle made of refractory material, by applying an argon gas pressure of 0.3 Kg/cm$^2$ to the molten alloy. In this way, the molten alloy was caused to rapidly cool and solidify on the surface of the roll. The experiments were carried out in the air. The results thus obtained are shown in Table 1. The values of coercive force Hc shown in Table 1 were obtained from the static magnetization curves of the alloys. Since the amorphous alloys according to the invention are soft magnetic, the values of coercive force Hc are desired to be as low as possible. The amorphous state in Table 1 was judged by X-ray diffraction experiments. The values of embrittlement rate $e_f$ in Table 1 obtained by bending tests were obtained by the following equation:

$$e_f=\frac{1}{1.8\times\frac{r}{t}+1}$$

where t is the thickness of the specimen, and r is the minimum radius of curvature at which a bending ruputre occurs. When a 180 degree complete bend is possible, the value $e_f=1$.

TABLE 1

| Specimen No. | Additive | Amorphous State | $H_c$ (Oe) | $e_f$ | Shape of Ribbon |
|---|---|---|---|---|---|
| 1 | V | Partly crystallized | 8 | 0.001 | No ribbon form achieved |
| 2 | Nb | Amorphous | 0.01 | 1.0 | Ribbon of 2 cm wide, with metallic luster |
| 3 | Cr | Partly | 0.8 | 0.02 | Ribbon of 2 cm wide, completely |

TABLE 1-continued

| Specimen No. | Additive | Amorphous State | $H_c$ (Oe) | $e_f$ | Shape of Ribbon |
|---|---|---|---|---|---|
| | | crystallized | | | oxidized (very brittle) |
| 4 | Mo | Partly crystallized | 1 | 0.01 | Ribbon of 2 cm wide, completely oxidized (very brittle) |
| 5 | W | Partly crystallized | 2 | 0.006 | No ribbon form achieved |
| 6 | Mn | Partly crystallized | 2 | 0.001 | Ribbon form, oxidized completely (very brittle) |
| 7 | Pt | Partly crystallized | 4 | 0.001 | No ribbon form achieved |
| 8 | Cu | Crystallized | 12 | 0.001 | " |
| 9 | Au | " | 10 | 0.001 | " |
| 10 | Al | " | 4 | 0.006 | Ribbon form, oxidized completely (very brittle) |
| 11 | Ru | Master alloys in molten state oxidized within nozzle in the air and can not be ejected. | | | |
| 12 | Rh | | | | |
| 13 | Ti | | | | |

As can be clearly seen in Table 1, only when Nb was added, the amorphous alloys of the (Fe—Co)—B system were readily obtainable in the form of ribbon having large width by the single roll process.

EXAMPLE 2

Experiments were conducted on alloys of the composition $Fe_{80-x}Nb_xB_{20}$ and the composition $Co_{80-x}Nb_xB_{20}$ (wherein x is 2, 5, 8, 10, 20 or 30) in the same manner as described by referring to example 1. The results thus obtained are shown in Tables 2 and 3 and FIGS. 1 and 2.

Figure 1:
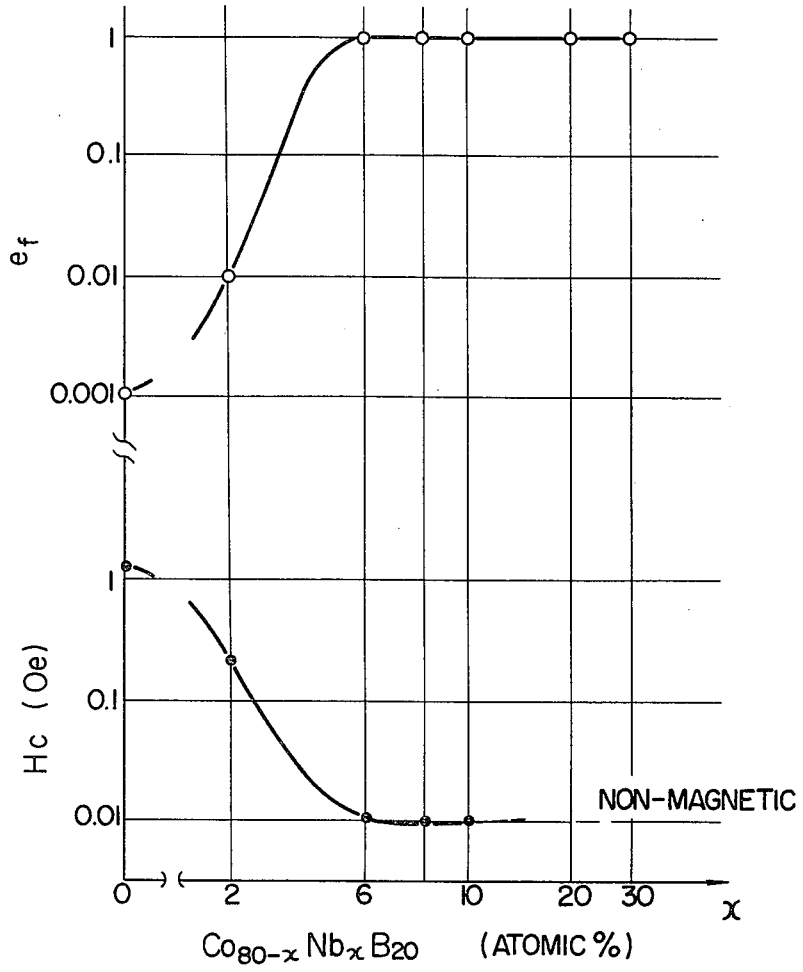
FIG. 1 is a graph showing characteristic curves of the coercive force $H_c$ and the embrittlement ratio $e_f$ in relation to the addition rate x in $Co_{80-x}Nb_xB_{20}$ comprising one embodiment of the invention.
Figure 2:
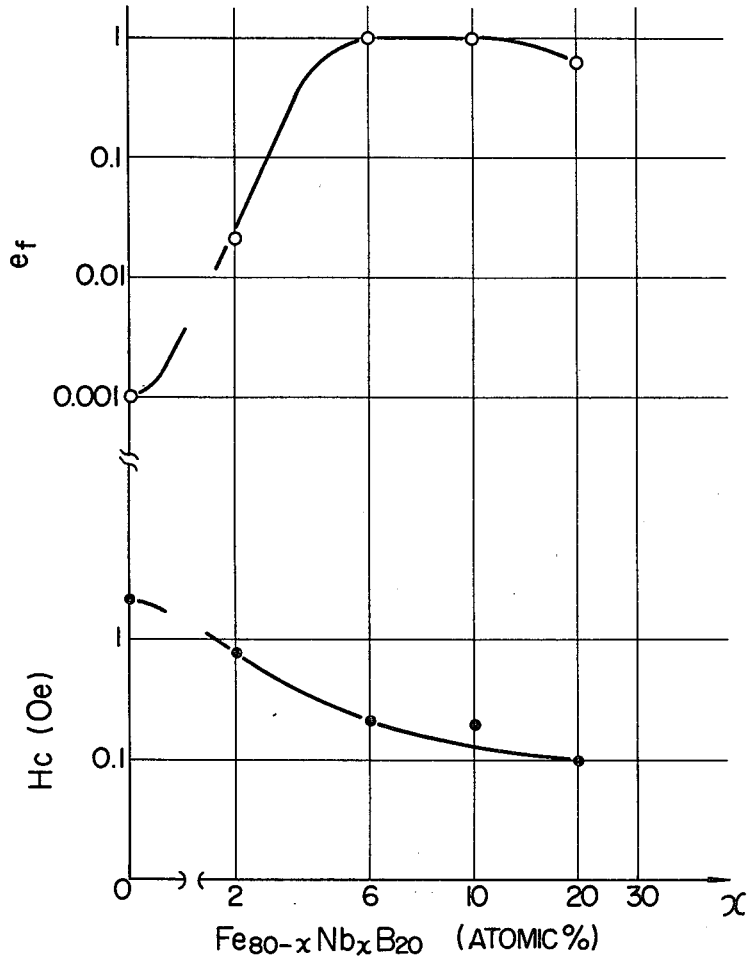
FIG. 2 is a graph showing characteristic curves of the coercive force $H_c$ and the embrittlement ratio $e_f$ in relation to the addition rate x in $Fe_{80-x}Nb_xB_{20}$ comprising another embodiment of the invention.

FIGS. 1 and 2 show changes in the characteristics of coercive force Hc and embrittlement rate $e_f$ with respect to the addition o rate x in $Nb_x$ determined on the basis of the values shown in Tables 2 and 3, respectively.

TABLE 2

$Co_{80-x}Nb_xB_{20}$

| Specimen No. | x | Shape of Ribbon | Hc (Oe) | $e_f$ |
|---|---|---|---|---|
| 14 | 0 | Ribbon very brittle due to complete oxidation | 1.2 | 0.001 |
| 15 | 2 | Ribbon of 2 cm wide having metallic luster, but very brittle | 0.2 | 0.01 |
| 16 | 6 | Ribbon of 2 cm wide having metallic luster, definite ribbon shape capable of 180 degree bending | 0.01 | 1.0 |
| 17 | 8 | Ribbon of 2 cm wide having metallic luster, definite ribbon shape capable of 180 degree bending | 0.01 | 1.0 |
| 18 | 10 | Ribbon of 2 cm wide having metallic luster, definite ribbon shape capable of 180 degree bending | 0.01 | 1.0 |
| 19 | 20 | Ribbon of 2 cm wide having metallic luster, definite ribbon shape capable of 180 degree bending | Substantially non-magnetic | 1.0 |
| 20 | 30 | Ribbon of 2 cm wide having metallic luster, definite ribbon shape capable of 180 degree bending | non-Magnetic | 1.0 |

TABLE 3

$Fe_{80-x}Nb_xB_{20}$

| Specimen No. | x | Shape of Ribbon | Hc (Oe) | $e_f$ |
|---|---|---|---|---|
| 21 | 0 | Ribbon, completely oxidized and very brittle | 2.0 | 0.001 |

TABLE 3-continued $Fe_{80-x}Nb_xB_{20}$

| Specimen No. | x | Shape of Ribbon | Hc (Oe) | $e_f$ |
|---|---|---|---|---|
| 22 | 2 | Ribbon of definite shape of 2 cm wide, although slightly oxidized and brittle | 0.8 | 0.02 |
| 23 | 6 | Ribbon of definite shape of 2 cm wide having metallic luster, capable of 180 degree bending | 0.2 | 1.0 |
| 24 | 10 | Ribbon of definite shape of 2 cm wide having metallic luster, capable of 180 degree bending | 0.2 | 1.0 |
| 25 | 20 | Ribbon form, although slightly brittle | 0.1 | 0.6 |
| 26 | 30 | Melting of master alloy in air or nozzle impossible due to oxidation | | |

From the aforesaid Tables and Figures, it will be clearly seen that to achieve the effects of addition of Nb, it is necessary that its content be over 2 atomic %, preferably over 6 atomic %, and that when conditions of preparation and magnetic properties are taken into consideration, it is preferable that the Nb content be below 20 atomic %. Also, by adding Nb, it becomes possible to achieve a 180 degree bending which has been hitherto impossible in the case of amorphous alloys of the Fe—B system and, further, since the amorphous alloys thus containing Nb according to the invention have high toughness, they have high mechanical properties indispensable to materials for producing mechanical-electromagnetic transducer devices.

EXAMPLE 3

Experiments were conducted on alloys of the composition $$(Fe_xCo_yNi_z)_{\frac{80}{100}}B_{20}$$

and the composition $$(Fe_xCo_yNi_z)_{\frac{74}{100}}Nb_6B_{20}$$

under the same conditions as described by referring to example 1, to obtain the crystallization temperature of the specimens. The results thus obtained are shown in Table 4.

The crystallization temperatures of the specimens were measured by the differential thermal analysis (D.T.A.) method. It has been found that even if the values of X, Y and Z in the composition $$(Fe_XCo_YNi_Z)_{\frac{74}{100}}Nb_6B_{20}$$

are varied, the addition of $Nb_6$ has such an effect that amorphous alloys in the form of ribbon of silver white color having a width of 4 cm and the embrittlement rate $e_f=1$ can be obtained by the single roll process.

TABLE 4

| Specimen No. | X | Y | Z | Crystallization temp. (°C.) of $(Fe_XCo_YNi_Z)_{\frac{80}{100}}B_{20}$ | Crystallization Temp. (°C.) of $(Fe_XCo_YNi_Z)_{\frac{74}{100}}Nb_6B_{20}$ |
|---|---|---|---|---|---|
| 27 | 100 | 0 | 0 | 410 | 535 |
| 28 | 50 | 50 | 0 | 400 | 500 |
| 29 | 0 | 100 | 0 | 380 | 470 |
| 30 | 0 | 50 | 50 | 340 | 425 |
| 31 | 0 | 0 | 100 | 310 | 400 |
| 32 | 50 | 0 | 50 | 400 | 475 |

It will be seen in Table 4, that as compared with the crystallization temperatures of the alloys $$(Fe_XCo_YNi_Z)_{\frac{80}{100}}B_{20}$$

of the prior art, those of the alloys $$(Fe_XCo_YNi_Z)_{\frac{74}{100}}Nb_6B_{20}$$

are higher by over 50° C. In this way, the addition of Nb can achieve the effect of raising the crystallization temperatures of the amorphous alloys by the results of the aforesaid experiments, so that the addition of Nb enables amorphous materials of high thermal stability to be obtained as one of the features of the invention.

EXAMPLE 4

Amorphous alloys of the composition $Fe_5Co_{77}Nb_8B_{10}$ and the composition $Fe_{74}Nb_6B_{20}$ were prepared by the same method as described by referring to example 1. The amorphous materials obtained and materials of the prior art were used for fabricating members similar in shape to the magnetic core of a track width of 600 μm that are commercially available. Magnetic heads were prepared by using these members as cores, and their wear resistance properties and Vickers hardness were determined. The results are shown in Table 5.

TABLE 5

| Specimen No. | Crystallization Condition | Core Material | Vickers Hardness (HV) | Wear (μm) after Running for 100 Hours |
|---|---|---|---|---|
| 33 | Crystallized | Ni-Fe Alloy | 120 | Up to 50 |
| 34 | Crystallized | Fe-Si-Al Alloy | 560 | Up to 5 |
| 35 | Amorphous | $Fe_{29}Ni_{49}P_{14}B_6Al_2$ | 792 | Up to 20 |
| 36 | " | $Fe_6Co_{72}Si_8B_{14}$ | 910 | Up to 6 |
| 37 | " | $Fe_{80}P_{13}C_7$ | 760 | Up to 10 |
| 38 | " | $Fe_5Co_{77}Nb_8B_{10}$ | 1420 | Up to 1.8 |

TABLE 5-continued

| Specimen No. | Crystallization Condition | Core Material | Vickers Hardness (HV) | Wear (μm) after Running for 100 Hours |
|---|---|---|---|---|
| 39 | " | $Fe_{74}Nb_6B_{20}$ | 1380 | Up to 2 |
| 40 | " | $Co_{81}Nb_{13}B_b$ | 1000 | Up to 1 |
| 41 | " | $Co_{84}Nb_{14}B_2$ | 900 | Up to 0.6 |

As can be seen in Table 5, the amorphous alloys of the (Fe—Co)—Nb—B system according to the invention have superior wear resistance properties. It will also be seen from Table 5 that when the amorphous alloys of the Nb—B system have B content below 10%, the alloys have particularly superior wear resistance properties among all of the amorphous alloys according to the invention and can be used for V.T.R.

In view of this, we have conducted research on the range of compositions capable of forming amorphous alloys containing M' (wherein M' is Fe, Co, Ni or Mn) and Nb as principal components and metalloids such as B of which content being below 10%. The results have revealed that alloys of the following formula (II) are capable of being rendered amorphous.

(II) Alloys of the formula $M'_aNb_bX_c$ wherein M' comprises one or two of the elements selected from the group consisting of Fe, Co, Ni and Mn and X comprises one or two of the elements selected from the group consisting of B, C, Si, Ge, Al and Sn, and wherein $70 \leqq a \leqq 94$, $6 \leqq b \leqq 30$ and $0.1 \leqq c < 10$ under the condition $a+b+c=100$.

It has been found that the amorphous alloys of this formula are higher in wear resistance than the amorphous alloys containing over 10% of metalloids such as B, as expected. Experiments were conducted on the wear resistance of the alloys of the formula (II) in the same manner as the alloys shown in Table 5. The results are shown in Table 6. The conditions of experiments only differed from those of the previous experiments in that the tape was run for 1000 hours.

TABLE 6

| Specimen No. | Crystallization Condition | Core Material | Wear (μm) after Running for 1000 Hours |
|---|---|---|---|
| 39 | Amorphous | $Fe_{74}Nb_6B_{20}$ | Up to 20 |
| 42 | " | $Fe_{85}Nb_6B_9$ | Up to 9 |
| 43 | " | $Fe_{86}Nb_7C_7$ | Up to 6 |
| 44 | " | $Fe_{82}Nb_{10}B_2Si_6$ | Up to 6 |
| 45 | " | $Fe_{82}Nb_{11}B_3Al_4$ | Up to 5 |
| 46 | " | $Fe_{70}Ni_{12}Nb_{12}B_3Sn_3$ | Up to 7 |
| 47 | " | $Co_{80}Nb_{14}B_4Ge_2$ | Up to 6 |
| 48 | " | $Co_{62}Ni_{10.5}Nb_{19.5}B_6C_2$ | Up to 7 |
| 49 | " | $Fe_2Co_{81}Nb_{15}B_1C_1$ | Up to 3 |
| 50 | " | $Fe_2Co_{81}Nb_{16.9}C_{0.1}$ | Up to 3 |
| 51 | Crystallized | $Co_{94}Nb_6$ | Up to 18 |

Figure 3:
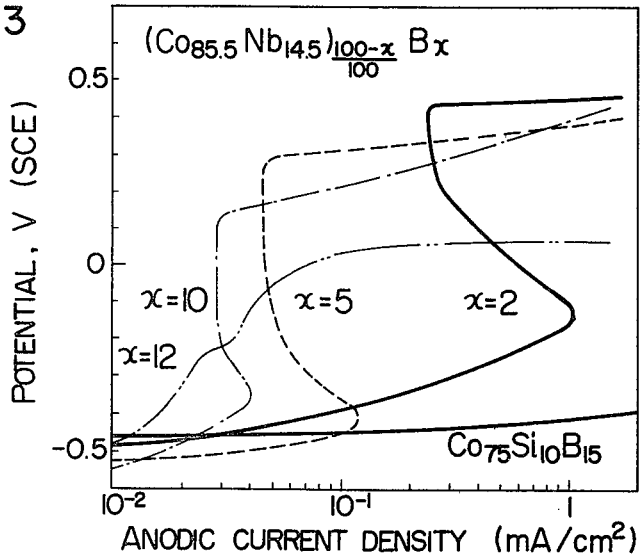
FIG. 3 is a graph showing corrosion voltage-current curves obtained in a 1 mol NaCl solution of amorphous alloys $$(Co_{85.5}Nb_{14.5})_{\frac{100-x}{100}}B_x$$

We have also found that the amorphous alloys containing below 10% of metalloids such as B and over 6% of Nb have high resistance to corrosion as well as to wear. The results of experiments shown in FIG. 3 show that the alloys of this type owe their high corrosion resistance to the formation of a passivated state film by Nb. When Nb is added in a content over 20%, the saturated magnetic flux density Bs is markedly reduced, so that, for practical reasons, it is desirable that the Nb content be below 20%.

It has been found that similar results can be obtained by using, in place of the elements designated by X, specific metals designated by T, such as Ti, Zr, Hf, V, Ta and Ru. When added in a content over 10%, these specific metals caused no deterioration to occur in the wear resistance properties of the amorphous alloys, unlike the elements designated by X. However, unlike the elements designated by X, these metals caused a marked deterioration in the saturated magnetic flux density of the alloys when added in a content over 5% and Zr particularly caused a marked deterioration in the corrosion resistance of the amorphous alloys. Thus, it is desired that these metals be added in a content below 5%, so as to enable the amorphous alloys to retain their advantages as magnetic alloys.

FIG. 4 shows changes in saturated magnetic flux density ($B_s$) that occurs when various elements indicated by X and T are added to the alloy of the system $Co_{85.5}Nb_{14.5}$. It is desirable that the content of Nb added be below 20% so as not to adversely affect saturated magnetic flux density ($B_s$) much. In view of the fact that the content of Nb added should be over 6% to render the alloys amorphous, the composition set forth hereinbelow would be considered desirable for practical purposes in this system of alloys.

(III) Alloys of the formula $M'_aNb_bT_d$ where T comprises Zr, Ti, Hf, V, Ta and Ru, and $75 \leqq a \leqq 94$, $6 \leqq b \leqq 20$ and $0.1 \leqq d < 5$ under the condition $a+b+d=100$. The amorphous alloys of the formula (III) have been found to have as good wear resistance and corrosion resistance properties as the amorphous alloys of the formula (II). Table 7 shows the results of wear resistance tests similar to the results of wear resistance tests shown in Table 6.

TABLE 7

| Specimen No. | Crystallization Condition | Core Material | Amount of Wear after 500 Hours |
|---|---|---|---|
| 52 | Amorphous | $Co_{75}Nb_{20}Ti_5$ | Up to 3 |
| 53 | " | $Co_{82}Nb_{14}Ta_4$ | Up to 3 |
| 54 | " | $Co_{85}Nb_{13}V_2$ | Up to 3 |
| 55 | " | $Fe_{90}Nb_7Hf_3$ | Up to 4 |
| 56 | " | $Fe_{93.9}Nb_6Zr_{0.1}$ | Up to 8 |
| 57 | " | $Fe_{90}Nb_9Zr_1$ | Up to 4 |
| 58 | " | $Co_{87}Nb_{10}Zr_3$ | Up to 3 |
| 59 | " | $Co_{84}Nb_{14}Ru_2$ | Up to 3 |
| 51 | Crystallized | $Co_{94}Nb_6$ | Up to 10 |

In view of the results shown hereinabove, it will be appreciated that the amorphous alloys containing both of the elements X and T can achieve superior results. That is, from the matters mentioned in relation to the formulas (II) and (III), the composition ranges of these alloys desirable for putting them into practical use are expressed with the following formula (IV).

(IV) Alloys of the formula $M'_aNb_bX_cT_d$ wherein $70 \leqq a < 94$, $6 \leqq b \leqq 20$, $0.1 \leqq c < 10$ and $0.1 \leqq d < 5$ under the condition $a+b+=100$. The amorphous alloys of this system have shown superior wear resistance properties, as expected. The results of experiments are shown in Table 8.

TABLE 8

| Specimen No. | Crystallization Condition | Core Material | Amount of Wear (μm) after 500 Hours |
|---|---|---|---|
| 60 | Amorphous | $Co_{70}Nb_{20}Ti_3B_7$ | Up to 6 |
| 61 | " | $Co_{75}Nb_{16}Zr_3Si_6$ | Up to 6 |
| 62 | " | $Co_{80}Nb_{14}Hf_3Ge_3$ | Up to 5 |
| 63 | " | $Co_{85}Nb_{10}Ta_3Al_2$ | Up to 4 |
| 64 | " | $Fe_{85}Nb_{10}V_2C_3$ | Up to 3 |
| 65 | " | $Fe_{88}Nb_8Zr_2Si_2$ | Up to 4 |
| 66 | " | $Fe_{93.8}Nb_6Zr_{0.1}B_{0.1}$ | Up to 9 |
| 67 | " | $Co_{81}Nb_{14}Hf_4Sn_1$ | Up to 5 |

Then, Y and rare earth elements were added to amorphous alloys containing the Co and Nb as the principal components, and experiments were conducted thereon to look into the results of the addition. It has been revealed that the addition of rare earth elements has no effect in rendering the amorphous alloy ribbon form in a super rapid cooling method using a single roll. Rather, it has been found that the addition of these elements in a content over 2% interferes with the amorphous alloys being formed into a ribbon. When a sputtering method or a vacuum evaporation method was used for forming a thin film of amorphous material, it has been found that the addition of Y and rare earth elements in slight content makes it possible to achieve excellent results because it markedly raises the crystallization temperature of the amorphous alloys. It has also been found, however, that when the amount added exceeded 5%, the soft magnetic properties of the Co—Nb film of the amorphous material are markedly impaired, causing a sudden increase in coercive force Hc. Thus, the composition ranges of these alloys desirable for putting them to practical use are as set forth hereinafter when the condition $6 \leqq b \leqq 20$ is taken into consideration, for the same reason as stated previously.

(V) Alloys of the formula $M'_aNb_bR_f$ wherein $75 \leqq a < 94$, $6 \leqq b \leqq 20$ and $0.1 \leqq f < 5$ under the condition $a+b+f=100$.

Table 9 shows changes in crystallization temperature (Tx) caused by the addition of Y and rare earth elements to the alloy of the system $Co_{85.5}Nb_{14.5}$.

TABLE 9

| Specimen No. | Composition | Crystallization Temp. Tx (°C.) |
|---|---|---|
| 68 | $Co_{85.5}Nb_{14.5}$ | 480 |
| 69 | $(Co_{85.5}Nb_{14.5})_{\frac{95}{100}}Y_5$ | 560 |
| 70 | $(Co_{85.5}Nb_{14.5})_{\frac{96}{100}}Sm_4$ | 580 |
| 71 | $(Co_{85.5}Nb_{14.5})_{\frac{97}{100}}Ce_3$ | 530 |
| 72 | $(Co_{85.5}Nb_{14.5})_{\frac{98}{100}}La_2$ | 550 |
| 73 | $(Co_{85.5}Nb_{14.5})_{\frac{98}{100}}Pr_2$ | 520 |
| 74 | $(Co_{85.5}Nb_{14.5})_{\frac{95}{100}}Gd_5$ | 600 |
| 75 | $(Co_{85.5}Nb_{14.5})_{\frac{96}{100}}Tb_4$ | 580 |
| 76 | $(Co_{85.5}Nb_{14.5})_{\frac{97}{100}}Ho_3$ | 530 |

FIG. 5 shows changes in the coercive force (Hc) of the amorphous alloys caused by the addition of rare earth elements. As stated above, addition of rare earth elements in slight content is effective in forming a film of the amorphous alloys of the Co—Nb system by the sputtering method or the vacuum evaporation method.

Generally, alloys can be rendered amorphous more readily when the sputtering method or the vacuum evaporation method is used than when the super rapid cooling method is used. It goes without saying, therefore, that by combining rare earth elements with the compositions of the formulas (II), (III) and (IV) it is possible to more rapidly produce a film of amorphous material. The composition ranges of the alloys that are desirable are as set forth hereinbelow.

(VI) Alloys of the formula $M'_aNb_bX_cR_f$ wherein $70 \leqq a < 94$, $6 \leqq b \leqq 20$, $0.1 \leqq c < 10$ and $0.1 \leqq f < 5$ under the condition $a+b+c+f=100$.

(VII) Alloys of the formula $M'_aNb_bV_dR_f$ wherein $75 \leqq a < 94$, $6 \leqq b < 20$, $0.1 \leqq d < 5$ and $0.1 \leqq f < 5$ under the condition $a+b+d+f=100$.

(VIII) Alloys of the formula $M'_aNb_{X_c}T_dR_f$ wherein $70 \leqq a < 94$, $6 \leqq b \leqq 20$, $0.1 \leqq c \leqq 5$, $0.1 \leqq d < 5$ and $0.1 \leqq f < 5$ under the condition $a+b+c+d+f=100$.

Next, tests were conducted on the amorphous alloys of the aforesaid compositions to determine their wear resistance in comparison with that of ferrite heretofore used in magnetic heads. The tests will be outlined by referring to FIG. 6. FIG. 6*a* is a plan view of a dummy head used in the wear resistance tests; FIG. 6*b* is a sectional view of the dummy head shown in FIG. 6*a;* and FIG. 6*c* is a view on an enlarged scale of the forward end portion of the dummy head shown in FIGS. 6*a* and 6*b*. In the tests, a film 12 of an amorphous alloys of the aforesaid composition was applied to the surface of a base 11 of Mn-Zn ferrite by the sputtering method in a thickness of 20 μm, and another base plate 13 of Mn-Zn ferrite was supperposed on the film 12 in a sandwich fashion, to provide a dummy head 10.

Then, the dummy head 10 of the ferrite-amorphous alloy compound body was mounted on a VTR deck by replacing the head actually mounted thereon. Thereafter, Co doped γ tape was brought into pressing engagement with a sliding surface 14 of the dummy head 10 in the usual manner and run for 100 hours. After tape running was stopped, the difference in the amount of wear, or the amount of offset wear Δl, between sliding surfaces or worn surfaces 14*f* of the ferrite base plates 11 and 13 and a sliding surface or worn surface 14*a* of the amorphous alloy film 12 was determined. Table 10 shows the results of tests, together with the compositions of the amorphous alloys used in the tests and the crystallization temperatures Tx thereof.

TABLE 10

| | Specimen No. | Composition | $T_x$ (°C.) | Δl: Offset Wear (μm) |
|---|---|---|---|---|
| Amorphous Alloys of Invention | 77 | $Co_{80}Nb_{12}C_4Y_4$ | 580 | 0.2 |
| | 78 | $Co_{80}Nb_{12}B_4Gd_4$ | 610 | 0.5 |
| | 79 | $Co_{85}Nb_{11}Zr_2La_2$ | 550 | 0.0 |
| | 80 | $Co_{85}Nb_{11}Hf_2Tb_2$ | 550 | 0.0 |
| | 81 | $Co_{80}Nb_{12}Ta_4Al_1Sm_3$ | 590 | 0.1 |
| | 82 | $Fe_2Co_{80}Nb_{12}Ti_2B_3Pr_1$ | 510 | 0.4 |
| Alloy of Prior Art | 83 | $Fe_5Co_{75}Si_4B_{16}$ | 410 | 20.0 |

As can be clearly seen in Table 10, the amorphous alloys according to the invention have high crystallization temperatures and superior wear resistance property, so that they are suitable as materials for forming a head core used in VTR. Since Nb forms a passivated state film, the amorphous alloys according to the invention are high in corrosion resistance too. The addition of rare earth elements has the effect of raising the crystallization temperatures of the amorphous alloys produced, when a film of amorphous material is formed by the sputtering method or the vacuum evaporation method.

From the foregoing description, it will be appreciated that the amorphous magnetic alloys according to the invention containing a magnetic metal element and Nb as the principal components have a high saturation magnetic flux density and excellent soft magnetic property, in addition to high wear resistance and corrosion resistance, so that they lend themselves to use as core materials for the magnetic head.

What is claimed is:

1. Amorphous alloy consisting of 60–94 atomic % of at least one of Fe, Co and Ni, and 2 to 20 atomic % of niobium, the balance being at least one other metal selected from the group consisting of Ti, Zr, Hf, V, Ta and Ru.

2. Amorphous alloy of the formula $M'_aNb_bT_d$ wherein M' is at least one metal selected from the group consisting of Fe, Co, Ni, Mn and Cr, and T is at least one metal selected from the group consisting of Ti, Zr, Hf, V, Ta and Ru, and wherein $75 \leqq a < 94$, $6 \leqq b < 20$ and $0.1 \leqq d < 5$ under the condition $a+b+d=100$.

3. Amorphous alloy of the formula $M'_aNb_bR_f$ wherein M' is at least one metal selected from the group consisting of Fe, Co, Ni, Mn and Cr, and R is at least one element selected from Y and rare earth elements, and wherein $75 \leqq a \leqq 94$, $6 \leqq b < 20$ and $0.1 \leqq f < 5$ under the condition $a+b+f=100$.

4. Amorphous alloy of the formula $M'_aNb_bT_dR_f$ wherein M' is at least one metal selected from the group consisting of Fe, Co, Ni, Mn and Cr, T is at least one metal selected from the group consisting of Ti, Zr, Hf, V, Ta and Ru, and R is at least one element selected from Y and rare earth elements, and wherein $75 \leqq a \leqq 94$, $6 \leqq b < 20$, $0.1 \leqq d < 5$ and $0.1 \leqq f < 5$ under the condition $a+b+d+f=100$.

* * * * *